US006860341B2

(12) United States Patent
Spielmann et al.

(10) Patent No.: US 6,860,341 B2
(45) Date of Patent: Mar. 1, 2005

(54) GEAR TRANSMISSION ASSEMBLY FOR ELECTRICAL POWER TOOL

(75) Inventors: David Spielmann, Geltendorf (DE); Othmar Gerschwiler, Ulisbach (CH); Armin Breitenmoser, Ulisbach (CH); Christian Laube, Untererendingen (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/442,041

(22) Filed: May 20, 2003

(65) Prior Publication Data

US 2004/0020669 A1 Feb. 5, 2004

(30) Foreign Application Priority Data

May 21, 2002 (DE) ..... 102 22 824

(51) Int. Cl.[7] ..... E21B 4/04
(52) U.S. Cl. ..... 173/216; 173/217; 173/48
(58) Field of Search ..... 173/47, 48, 216, 173/217; 408/124, 126; 475/169

(56) References Cited

U.S. PATENT DOCUMENTS 3,500,696 A * 3/1970 Berube ..... 74/363
3,872,742 A * 3/1975 States ..... 475/299
4,493,223 A * 1/1985 Kishi et al. ..... 74/371
4,710,071 A * 12/1987 Koehler et al. ..... 408/133
4,791,833 A * 12/1988 Sakai et al. ..... 475/299
5,339,908 A * 8/1994 Yokota et al. ..... 173/216
6,086,502 A * 7/2000 Chung ..... 475/299
6,431,289 B1 * 8/2002 Potter et al. ..... 173/47

* cited by examiner

*Primary Examiner*—Scott A. Smith
*Assistant Examiner*—Nathaniel Chukwurah
(74) *Attorney, Agent, or Firm*—Sidley Austin Brown & Wood, LLP

(57) ABSTRACT

A gear transmission assembly for an electrical power tool includes a housing (6), a multi-stage gear train (1) located in the housing and having a plurality of axially displaceable indexing gears (4*a*, 4*b*) associated with respective stages of the gear train (1) and a shift device (2) for shifting the gear train (1) from one stage to another and having a shifting slide (3) displaceable from one shift stage to another, and a plurality of springable shifting stirrups (5*a*, 5*b*) connected with the shifting slide (3) and cooperating with respective indexing gears (4*a*, 4*b*) for displacing same in response to displacement of the shifting slide (3) between shift stages.

8 Claims, 6 Drawing Sheets

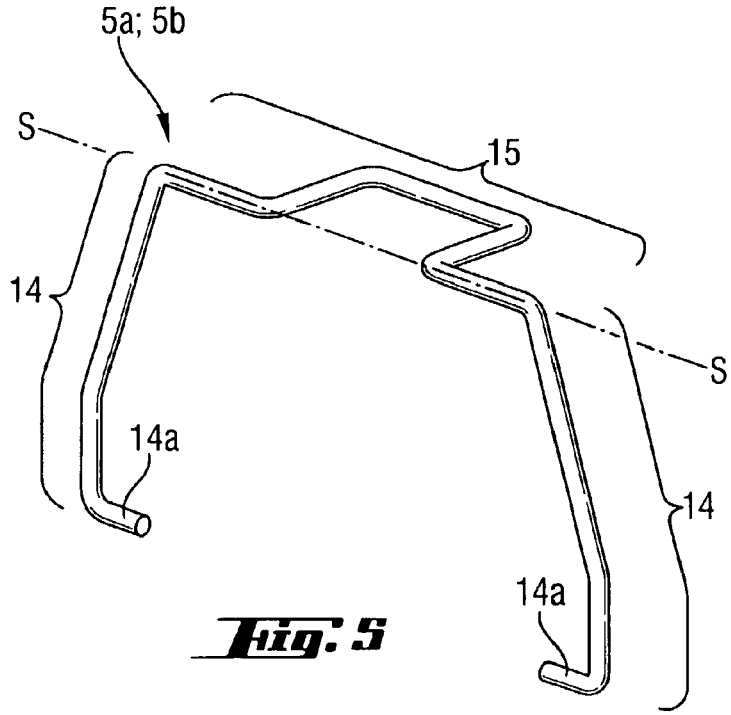
Fig. 5
Fig. 6
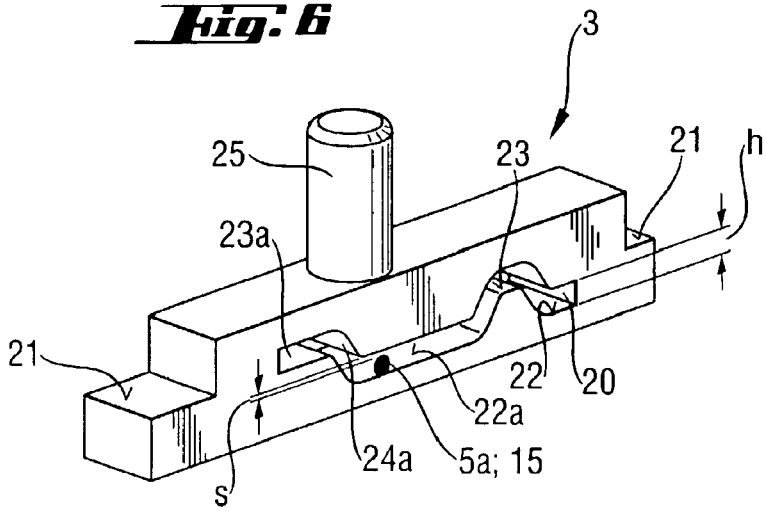

GEAR TRANSMISSION ASSEMBLY FOR ELECTRICAL POWER TOOL

BACKGROUND OF THE INVENTION

1. Field of the Invention

The present invention relates to a gear transmission assembly for an electrical power tool and including a two-stage gear train located in the housing and having an axially displaceable indexing gear, and a shift device for shifting the gear train from one stage to another and having a shifting slide displaceable from one shift stage to another, and a springable shifting stirrup connected with the shifting slide and cooperating with the indexing gear for displacing same in response to displacement of the shifting slide between shift stages.

2. Description of the Prior Art

Gear transmission assemblies of the type described above are used in electrical power tools in order to adapt a rotational speed of a power tool and, thus, of a used working tool, e.g., a screw bit, drill, etc. . . . to prevailing condition.

German Publication DE 3 904 085 discloses a gear transmission assembly for an electrical power tool and including a multi-stage gear train located in the assembly housing and shifting means for shifting the gear train from one stage to another. The gear transmission assembly includes a shifting slide displaceable between shift stages and a springable shifting stirrup connected with the shifting slide and cooperating with an indexing gear or axially displacing the indexing gear in response to displacement of the shifting slide.

The advantage of the known gear transmission assembly consists in that for shifting the gear train between two stages always a single gear train shift suffice.

A drawback of the known gear transmission assembly consists in that for a gear train with more than two stages, several shifting slides are needed.

Accordingly, an object of the present invention is to provide a multi-stage gear transmission assembly that can be economically produced.

Another object of the present invention is to provide a gear transmission assembly having a gear train with more than two stages with a convenient shifting between the stages.

SUMMARY OF THE INVENTION

These and other objects of the present invention, which will become apparent hereinafter, are achieved by providing a gear transmission assembly including a shift mechanism having a shifting slide displaceable from one shift stage to another, and a plurality of springable shifting stirrups connected with the shifting slide and cooperating with respective indexing gears for displacing same in response to displacement of the shifting slide between shift stages.

With the use of several indexing gears, more than two stages can be provided in the gear train, and with the use of several shifting stirrups connected with a single shifting slide and cooperating with respective indexing gears, an easy shifting from one stage to another is insured. By axially displacing the shifting slide, a reliable shifting from one stage to another stage is insured. The springable shifting stirrups insure a reliable shift, in particular when the gear train is shifted at a standstill as the shifting stirrups provide for engagement of respective elements of the gear train upon actuation of the gear train at the latest.

Advantageously, each of the shifting stirrups is pivotally supported on an axle fixedly secured on the assembly housing in order to insure a defined shift position of a respective indexing gear and, thereby, a reliable shifting to a desired stage. Advantageously, there are provided on and in the housing elements for guiding the shifting stirrups, in particular, through-bores for receiving sections of the shifting stirrups. With a pivotal support of the shifting stirrup on an assembly housing, force transmission between an actuation force acting on the shifting slide and an adjusting force acting on a respective indexing gear becomes possible due to a lever action. The degree of the force transmission depends on the position of the pivot axle on the housing.

Advantageously, each shifting stirrup has at least one engagement part and at least one shifting part, with the engagement part cooperating with the indexing gear and with the shifting part transmitting the actuation force from the shifting slide to the engagement part.

The shifting slide advantageously has at least one opening for receiving the shifting part which insures a compact structure. The opening can be easily formed and its facilitates the assembly of the gear transmission assembly.

The at least one opening extends transverse to a longitudinal axis of the gear train and substantially tangentially to the indexing gears. This insures a simple assembly and a reliable guidance of the shifting parts in the shifting slide.

Advantageously, the at least one opening of the shifting slide is formed as a control slot for pivoting the shifting stirrups about their respective pivot axles. This insures a constructionally simple and economical control of the shifting stirrups with the shifting slide. The control slot provide for appropriate displacement of separate shifting stirrups in accordance with the position of the shifting slide and, thereby, for the displacement of the indexing gear.

Advantageously, it is the shifting parts of the shifting stirrups that extend through the opening and function as connection elements.

In order to insure an optimal shift, the opening has, in the direction transverse to the longitudinal axis of the gear train, a height corresponding to the diameter of the shifting part plus a clearance. The clearance makes possible production of the gear train with high tolerances which contributes to the reduction of manufacturing costs.

Advantageously, the control slot has two shift stages, and further different and associated with each other, switch stages connected by a ramp The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The Drawings Show:

FIG. 5 a perspective view of the switching stirrup;

FIG. 6 a perspective view of the switching slide; and

FIG. 7 a perspective, cross-sectional view of a second embodiment of a gear train according to the present invention with a planetary gear and a spur gear.

DETAILED DESCRIPTION OF THE PREFERRED EMBODIMENTS

Figure 1A:
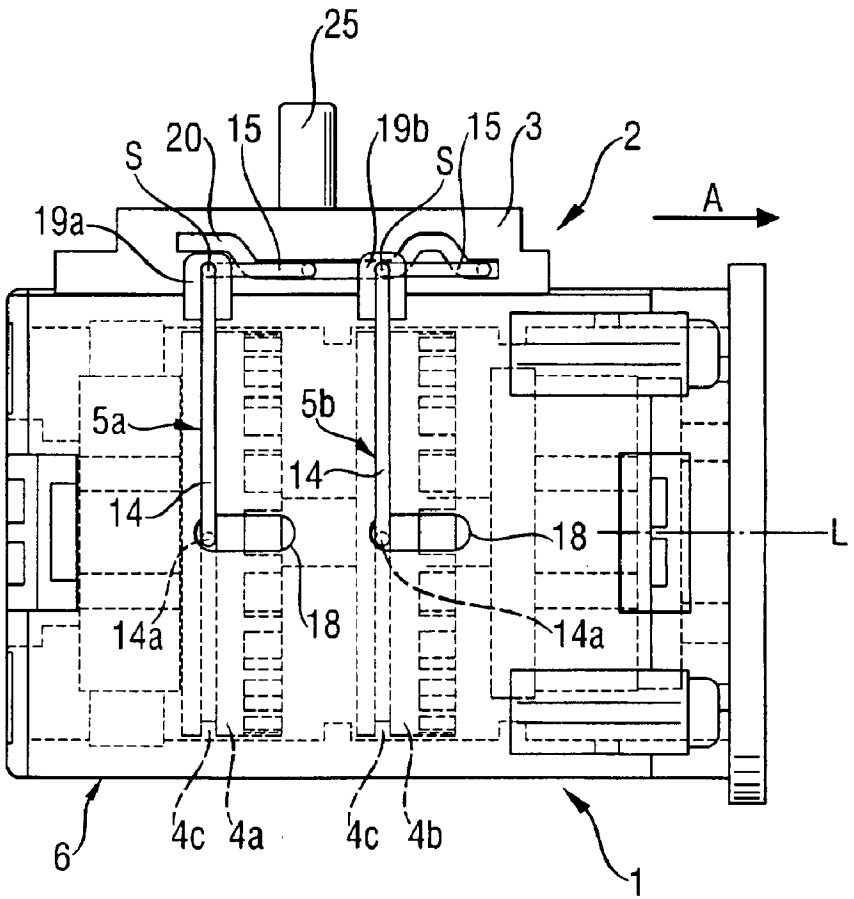
FIG. 1*a* a side view of a first embodiment of a gear train according to the present invention in a first stage.

FIGS. 1 through 7 shown a gear train 1 of a gear transmission assembly according to the present invention of an electrical tool which is adjoined in the operational direction A by a chuck (FIG. 4) for receiving a tool holder, e.g., of a screw bit. The gear train 1 is located in a substantially cylindrical housing 6 formed, e.g., of a plastic material and the like. The inventive gear transmission assembly further includes a shift mechanism 2 for shifting the gear train 1 from one stage to another. The shift mechanism 2 includes a spring-biased shifting slide 3 displaceable between three shift stages shown in particular in FIGS. 1*a*, 2*a*, 3*a*, and first and second shifting stirrups 5*a* and 5*b* which act on respective, axially displaceable indexing gears 4*a*, 4*b*.

FIG. 5 shows a U-shaped shifting stirrup 5*a*, 5*b* having a shifting part 15 and two engagement parts 14 which form free ends 14*a* of the shifting stirrup 5*a*, 5*b*, with the shifting part 15 connecting the two engagement parts 14*a* with each other. The free ends 14*a* are bend inward with respect to respective engagement parts 14 at an angle of about 90°, so that the free ends 14*a* extend toward each other. The free ends 14*a* are brought in respective recesses formed as annular grooves 4*c* and provided on respective indexing gears 4*a*, 4*b* which are associated with respective shifting stirrups 5*a*, 5*b*. The free ends 14*a* of the respective engagement parts 14 extend through the housing 6 through respective, arranged diametrically opposite each other, axially extending elongate openings 18. The shifting stirrups 5*a*, 5*b* are formed as springable members, e.g., of spring steel and the like. The gear train housing 6 has two support elements 19*a*, 19*b* for pivotally supporting the respective shifting stirrups 5*a*, 5*b*. The support elements 19*a*, 19*b* support the respective shifting stirrups 5*a*, 5*b* for pivotal movement about a pivot axis S. The shifting parts 15 of the respective shifting stirrups 5*a*, 5*b* extend through corresponding through-openings next to the shifting slide 3.

FIG. 6 shows shifting slide 3 which has a shape of a substantially right parallelepiped and which is axially displaceably supported on the gear train housing 6. The shifting slider 3 has a recess that extends transverse to the longitudinal axis L of the gear train 1 and substantially tangentially to the indexing gears 4*a*, 4*b*. The recess is formed, in particular, as a control slot 20. The control slot 20 extends axially along the gear train 1 and has, at each of its opposite ends, a reduced section 21. The shifting stirrups 5*a*, 5*b* have their shifting parts 15 extending through the control slot 20, and the shifting stirrups 5*a*, 5*b* have their shifting parts 15 arranged in the control slot 20 for pivotal movement about respective pivot axis S. In order to provide for pivotal movement of the shifting parts 15 in the control slot 20, the control slot 20 has, in a direction transverse to the longitudinal axis of the gear train 1, a height that substantially corresponds to the diameter of the shifting part 15 plus a clearance S. The control slot 20 has two shifting steps 22, 23, with correspondingly, spaced therefrom, shifting steps 22*a*, 23*a* being connected by a ramp 24*a*. On its side surface remote from the gear train housing 6, the shifting slide 3 has an actuation member 25 for displacing the shifting slide 3.

Figure 1B:
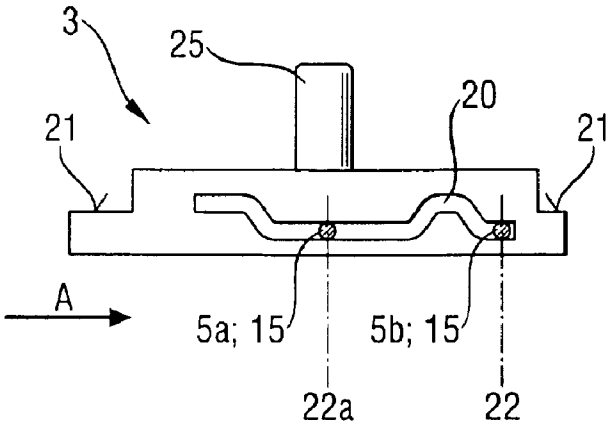
FIG. 1*b* a side view of a shifting slide shown in FIG. 1*a* with positions of the first and second shifting parts.
Figure 2A:
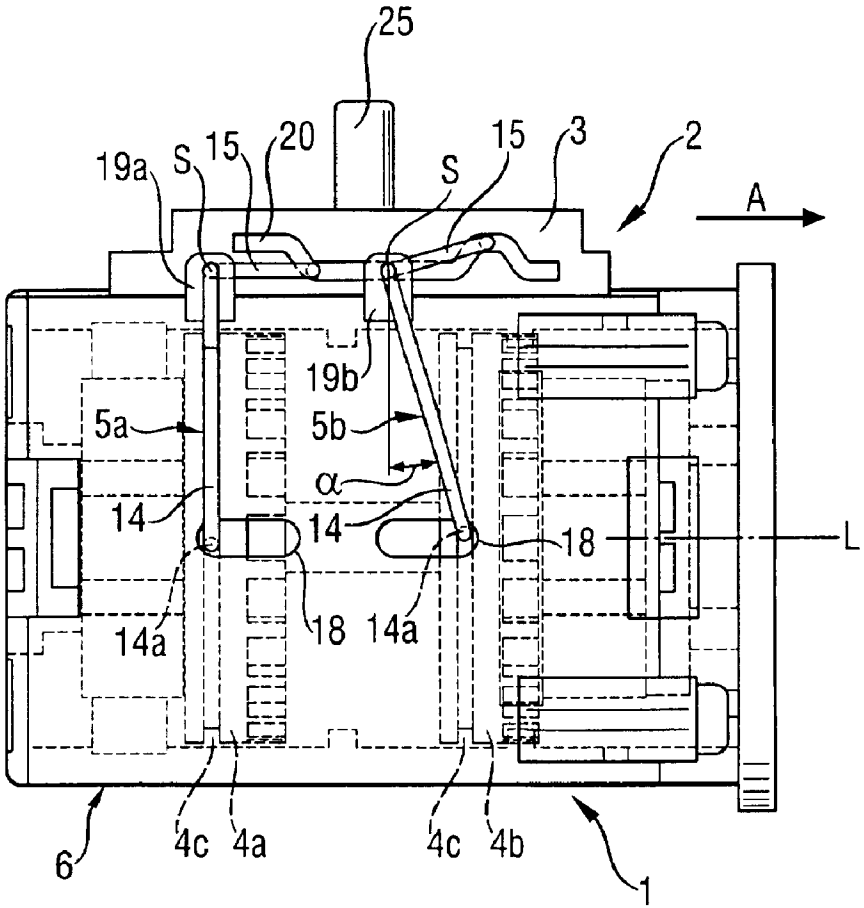
FIG. 2*a* a side view of a first embodiment of a gear train according to the present invention in a second stage.
Figure 2B:
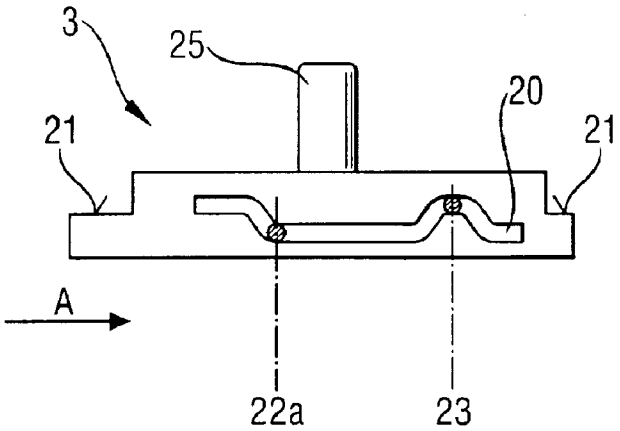
FIG. 2*b* a side view a shifting slide shown in FIG. 2*a* with positions of the first and second shifting parts.

The shifting slide 3 provides for shifting the gear train 1 between different stages. FIGS. 1*b*, 2*b*, 3*b* show the positions of the shifting parts 15 of the shifting stirrups 5*a*, 5*b* (the shifting parts 15 being shown in cross-section) in the control slot 20 for different stages of the gear train 1. FIG. 1*a* shows the gear train 1 in its first stage, with the shifting stirrups 5*a*, 5*b* extending transverse to the longitudinal axis L of the gear train, as can be seen in FIG. 1*b*. In FIG. 2*a*, the shifting slide 3 is displaced in the operational direction A, and the gear train 1 is in its second stage. The shifting part 15 of the second shifting stirrup 5*b* is displaced to the second shifting step 23 of the control slot 20 so that the second shifting stirrup 5*b* pivots about its pivot axis S by an angle $\alpha$. The pivotal movement of the second shifting stirrup 5*b*, in particular, of its engagement part 14 leads to the axial displacement of the second indexing gear 4*b*.

Figure 3A:
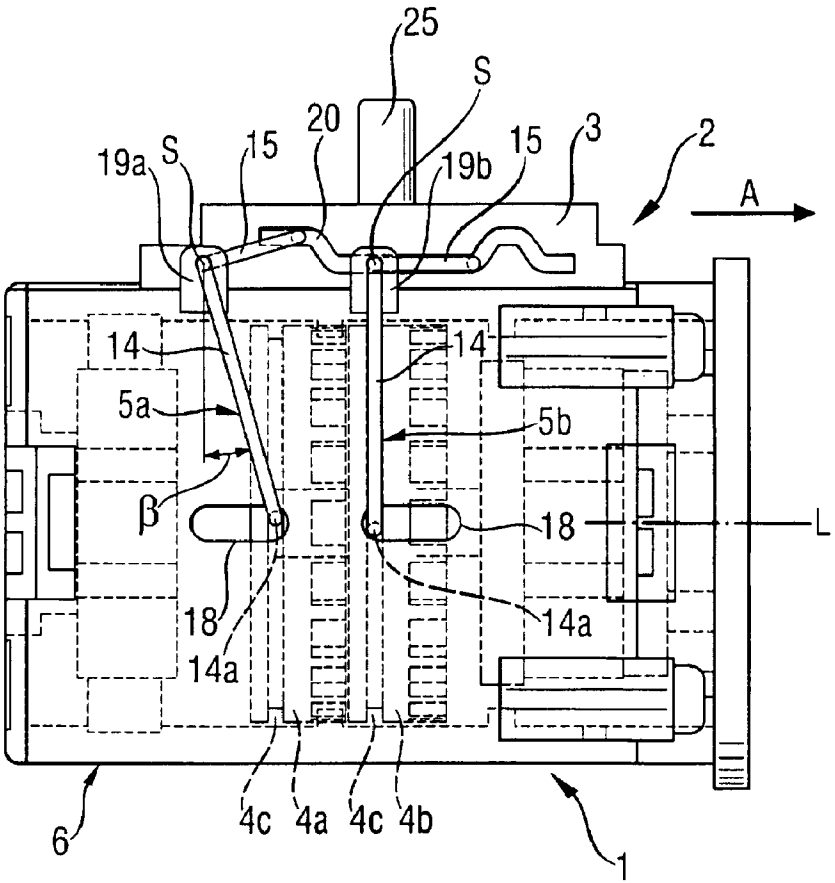
FIG. 3*a* a side view of a first embodiment of a gear train according to the present invention in a third stage.
Figure 3B:
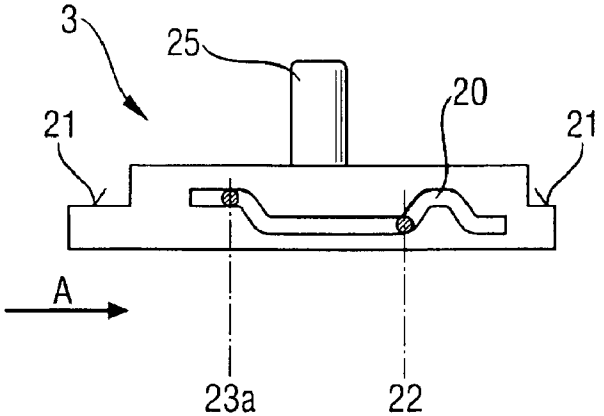
FIG. 3*b* a side view a shifting slide shown in FIG. 3*a* with positions of the first and second shifting parts.

Upon further movement of the shifting slide 3 in the operational direction A, the shifting slide 3 occupies a position shown in FIG. 3*a*, with the gear train 1 being shift to its third stage. In this position of the shifting slide 3, the shifting part 15 of the first shifting stirrup 5*a* is displaced along the ramp 24*a* to a second shifting step 23*a* of the control slot 20, which results in a pivotal movement of the first shifting stirrup 5*a* about its axis S by an angle $\beta$.

Figure 4:
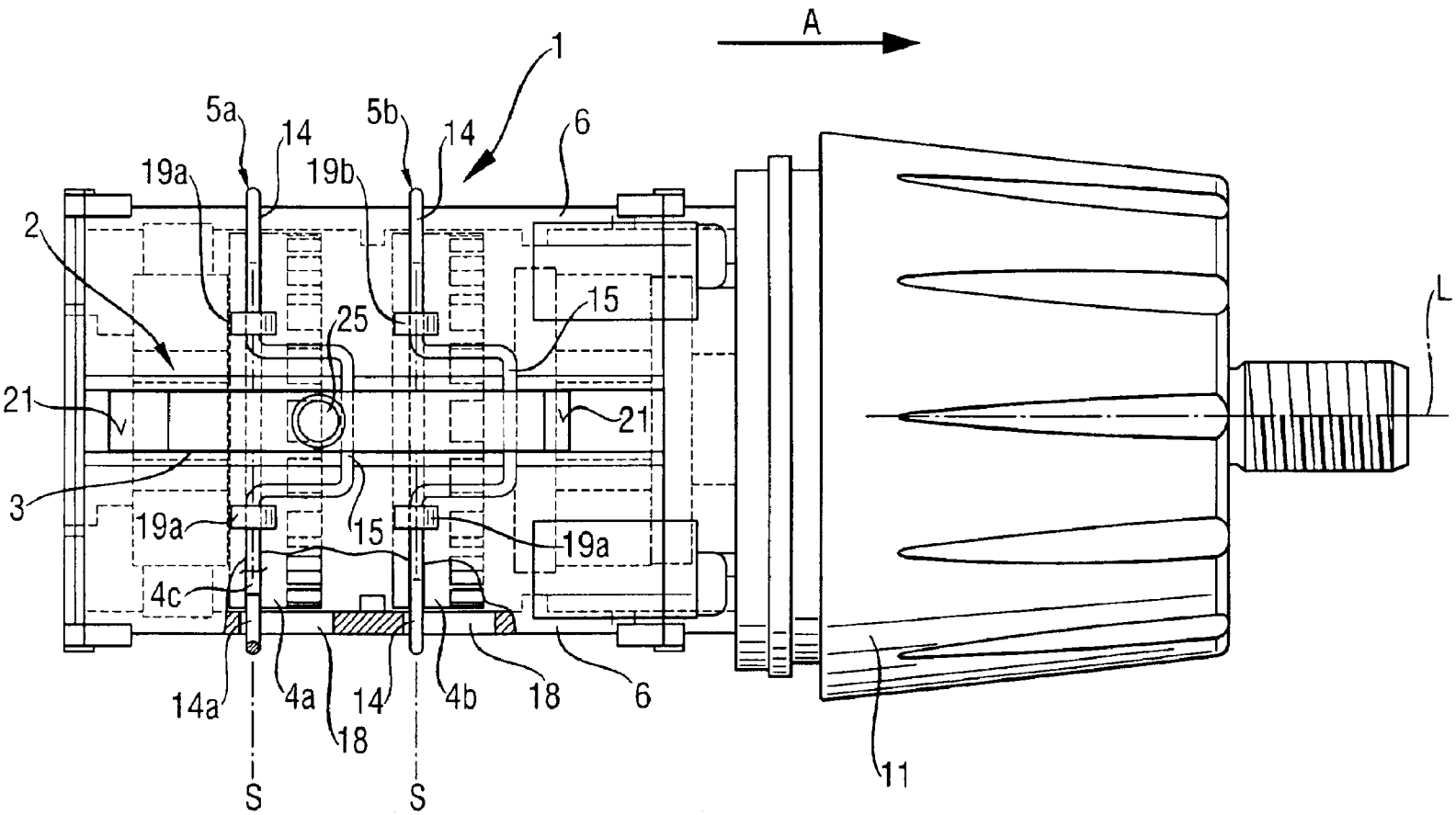
FIG. 4 a top, partially cross-sectional view of the gear train shown in FIG. 1.
Figure 1:
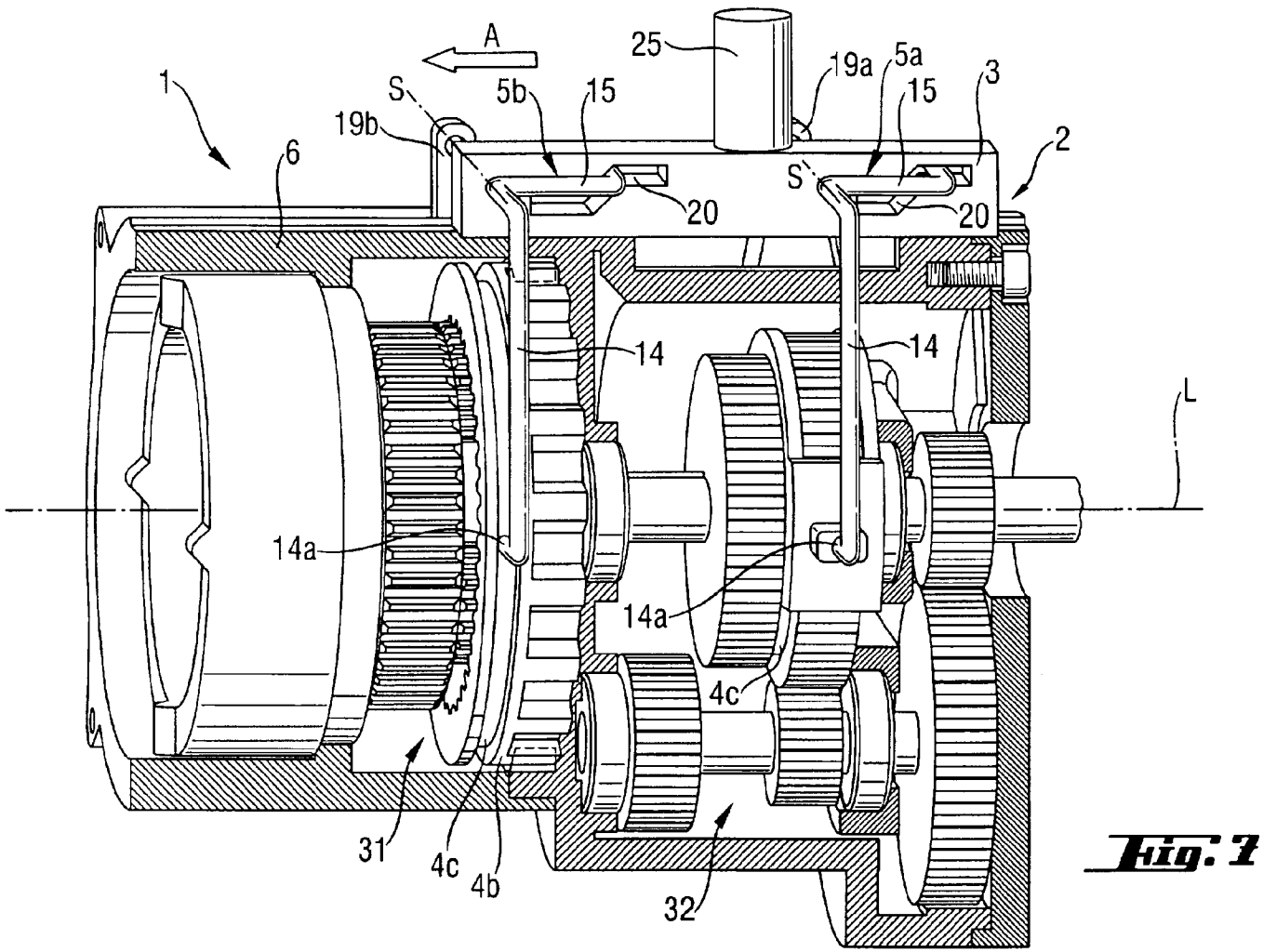

As particularly shown in FIG. 4, the gear train 1 has two planetary gears arranged one after another along the longitudinal axis L of the gear train 1.

In FIG. 7, the gear train 1 has, instead of two planetary gears, a planetary gear 31 and a spur gear 32.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A gear transmissing assembly for an electrical power tool, comprising a housing (6); a multi-stage gear train (1) located in the housing and having a plurality of axially displaceable indexing gears (4*a*, 4*b*) associated with respective stages of the gear train (1); and shift means (2) for shifting the gear train (1) from one stage to another, the shift means having a shifting slide (3) displaceable from one shift stage to another, and a plurality of springable shifting stirrups (5*a*, 5*b*) connected with the shifting slide (3) and cooperating with respective indexing gears (4*a*, 4*b*) for displacing the respective indexing gears in response to displacement of the shifting slide (3) between shift stages, wherein each shifting stirrup (5*a*, 5*b*) is pivotally supported on an axle (S) fixedly secured to the housing (6).

2. A gear transmission assembly according to claim 1, wherein each shifting stirrup (5*a*, 5*b*) has at least one engagement part (14) and at least one shifting part (15) for displacing a corresponding indexing gear (4*a*, 4*b*).

3. A gear transmission assembly according to claim 2, wherein the shifting slide (3) has at least one opening for receiving the shifting parts (15) of the shifting stirrups (5*a*, 5*b*).

4. A gear transmission assembly according to claim 3, wherein the at least one opening extends transverse to a longitudinal axis (L) of the gear train (1) and substantially tangentially to the indexing gears (4*a*, 4*b*).

5. A gear transmission assembly according to claim 4, wherein the at least one opening has, in a direction transverse to the longitudinal axis (L) of the gear train (1), a height (h) that correspond substantially to a diameter of the shifting part (15) plus a clearance (s).

6. A gear transmission assembly according to claim 3, wherein the at least one opening is formed as a control slot (20) for pivoting the shifting stirrups (5*a*, 5*b*) about respective pivot axes (S) thereof.

7. A gear transmission assembly according to claim 6, wherein the control slot (20) has two shift stages (22, 23) and two further corresponding shift stages (22*a*, 23*a*) connected by a ramp (24*a*).

8. A gear transmission assembly according to claim 3, wherein the shifting parts (15) of respective shifting stirrups (5*a*, 5*b*) extend through the at least one opening.

* * * * *